US007331766B2

(12) United States Patent
Barowsky et al.

(10) Patent No.: US 7,331,766 B2
(45) Date of Patent: Feb. 19, 2008

(54) COMPRESSOR

(75) Inventors: Helmut Barowsky, Bergfelde (DE); Wolfgang Ullrich, Halle (DE)

(73) Assignee: Bitzer Kuehlmaschinenbau GmbH, Sindelfingen (DE)

( * ) Notice: Subject to any disclaimer, the term of this patent is extended or adjusted under 35 U.S.C. 154(b) by 749 days.

(21) Appl. No.: 10/891,659

(22) Filed: Jul. 14, 2004

(65) Prior Publication Data

US 2005/0011704 A1 Jan. 20, 2005

(30) Foreign Application Priority Data

Jul. 16, 2003 (DE) ..... 103 33 402

(51) Int. Cl.
*F04B 49/10* (2006.01)
*F01M 9/00* (2006.01)
*F01M 1/04* (2006.01)

(52) U.S. Cl. ..... 417/13; 417/12; 417/63

(58) Field of Classification Search ..... 417/12, 417/13, 63; 184/6.1, 6.5, 6.6
See application file for complete search history.

(56) References Cited

U.S. PATENT DOCUMENTS 2,137,220 A 11/1938 Aikman
2,878,990 A 3/1959 Zuercher
3,411,313 A * 11/1968 Brown et al. ..... 62/192
3,426,962 A 2/1969 Shaw
5,257,539 A * 11/1993 Gale et al. ..... 73/293
5,765,994 A * 6/1998 Barbier ..... 417/12
6,276,901 B1 8/2001 Farr et al.

FOREIGN PATENT DOCUMENTS

DE 1 093 387 11/1960
WO 99/13225 3/1999
WO 00/65232 11/2000

* cited by examiner

*Primary Examiner*—Charles G Freay
(74) *Attorney, Agent, or Firm*—Lipsitz & McAllister LLC

(57) ABSTRACT

In a compressor for gaseous media, in particular, refrigerants, comprising a housing, a drive shaft mounted in the housing, at least one compressor unit arranged in the housing and driven by the drive shaft, and an oil lubricating device for supplying bearing areas of the drive shaft with lubricating oil, in order to solve the problem that the compressor should be shut down when the oil supply of the oil lubricating device fails, it is proposed that the oil lubricating device comprise a lubricating oil reservoir lying above an oil sump in the housing and fillable from the oil sump by a lubricating oil conveying device, that the oil lubricating device comprise a lubricating oil duct system extending through the drive shaft for taking up lubricating oil from the lubricating oil reservoir via an inlet disposed on the drive shaft and conducting it to the bearing areas, and that a lubricating oil monitoring device be provided for detecting by means of a sensor associated with the lubricating oil reservoir the presence of lubricating oil in the lubricating oil reservoir and switching off the compressor when there is a shortage of lubricating oil.

10 Claims, 3 Drawing Sheets

COMPRESSOR

The present disclosure relates to the subject matter disclosed in German application No. 103 33 402.5 of Jul. 16, 2003, which is incorporated herein by reference in its entirety and for all purposes.

BACKGROUND OF THE INVENTION

The invention relates to a compressor for gaseous media, in particular, refrigerants, comprising a housing, a drive shaft mounted in the housing, at least one compressor unit arranged in the housing and driven by the drive shaft, and an oil lubricating device for supplying bearing areas of the drive shaft with lubricating oil.

Such compressors are known from the prior art. Herein there is always the problem that the compressor should be shut down when the oil supply of the oil lubricating device fails.

SUMMARY OF THE INVENTION

This problem is solved with a compressor of the kind described at the outset, in accordance with the invention, in that the oil lubricating device comprises a lubricating oil reservoir lying above an oil sump in the housing and fillable from the oil sump by a lubricating oil conveying device, in that the oil lubricating device comprises a lubricating oil duct system extending through the drive shaft for taking up lubricating oil from the lubricating oil reservoir via an inlet disposed on the drive shaft and conducting it to the bearing areas, and in that a lubricating oil monitoring device is provided for detecting by means of a sensor associated with the lubricating oil reservoir the presence of lubricating oil in the lubricating oil reservoir and switching off the compressor when there is a shortage of lubricating oil.

The advantage of this solution is to be seen in the fact that one can directly monitor whether there is sufficient lubricating oil available for the lubricating oil duct system by means of a sensor associated with the lubricating oil reservoir. One can thus directly ascertain with the sensor and the lubricating oil monitoring device when the supply of the oil lubricating device is no longer functioning in the desired manner.

In principle, it is conceivable to design the sensor such that it detects a flow of lubricating oil into the lubricating oil duct system.

The sensor is of particularly simple and reliable design when it is constructed as a sensor which reacts to contact with lubricating oil.

Such a sensor reacting to contact with lubricating oil can be designed in many different ways.

An advantageous solution provides for this sensor to be designed as an optical sensor whose optical device changes its optical characteristics upon contact with lubricating oil.

Another advantageous solution provides for the sensor to be designed as a heated thermoelement which is cooled upon contact with lubricating oil, but heats up in the absence of contact with the lubricating oil.

In principle, the sensor could only be used when the unstable operating states caused by operating conditions, during which the oil lubricating device is inoperative for a short time, no longer prevail.

In such a case, one can reliably ascertain with the sensor whether lubricating oil is always present.

Such a lubricating oil monitoring can also be used in a particularly simple way for monitoring unstable operating states caused by operating conditions by the lubricating oil monitoring device recognizing a shortage of lubricating oil whenever the sensor associated with the lubricating oil reservoir detects no lubricating oil beyond a certain period of time.

This means that the certain period of time can be specified as waiting time during which the lubrication may discontinue or fail for a short time, but if the waiting time is exceeded, the lubricating oil monitoring device shuts down the compressor.

It is thus possible, for example, to bridge the starting-up phase of the compressor during which the lubricating oil reservoir may initially be empty and the lubricating oil conveying device is not conveying sufficient lubricating oil to the lubricating oil reservoir. This phase can be incorporated by specifying a certain period of time during which a shortage of lubricating oil may occur and which has to be exceeded in order for the compressor to be shut down. Consequently, if the shortage of lubricating oil lasts for a shorter time than the specified period of time, the compressor will not be shut down.

The lubrication can be monitored particularly advantageously when the sensor is associated with the lubricating oil reservoir in such a way that it detects a specified filling level of a lubricating oil bath in the lubricating oil reservoir. By maintaining a lubricating oil bath in the lubricating oil reservoir, sufficient lubricating oil can also be made available for short-term inoperability of the lubricating oil conveying device so as to maintain the lubrication substantially constantly.

It is particularly expedient for the filling level of the lubricating oil bath in the lubricating oil reservoir, which is to be detected by the sensor, to be specified by it being above the inlet for lubricating oil disposed on the drive shaft, so that lubricating oil is always picked up at the inlet free from air or gases.

For reasons of constructional simplicity, it is particularly advantageous for the lubricating oil in the lubricating oil reservoir to enter the inlet substantially free from being acted upon by pressure, so that no measures are required for making lubricating oil under pressure available for the lubricating oil duct system.

The lubricating oil duct system is expediently constructed such that with the drive shaft rotating, it conveys lubricating oil as a result of the centrifugal forces from the inlet to the bearing areas to be supplied. It is thus merely sufficient to let the drive shaft rotate in order to lubricate the bearing areas to a sufficient extent.

The lubricating oil reservoir is expediently arranged in the area of a housing wall on which the drive shaft abuts, so that no complicated constructional measures are required for ensuring operation of the oil lubricating device.

To allow the lubricating oil to pass in a simple way from the lubricating oil reservoir into the lubricating oil duct system, the inlet of the lubricating oil duct system is disposed at an end face of the drive shaft, with which the drive shaft abuts on the lubricating oil reservoir.

Further details of the design of the lubricating oil conveying device were not given in the above explanation of the individual embodiments.

This can be designed in many different ways. For example, the lubricating oil conveying device could be designed as a screw conveyor or any kind of conveyor for lubricating oil.

A particularly favorable solution provides for the lubricating oil conveying device to comprise an impeller.

Such an impeller can be mounted in a constructionally particularly simple way on the drive shaft and rotates along with the drive shaft. The impeller dips into the oil sump in the area near the bottom of the housing so as to whirl the oil out of the oil sump into areas above it, in particular, onto a wall from which the oil can run into the lubricating oil reservoir.

Further features of the inventive solution are the subject matter of the following description and the drawings of an embodiment.

DETAILED DESCRIPTION OF THE INVENTION

Figure 1:
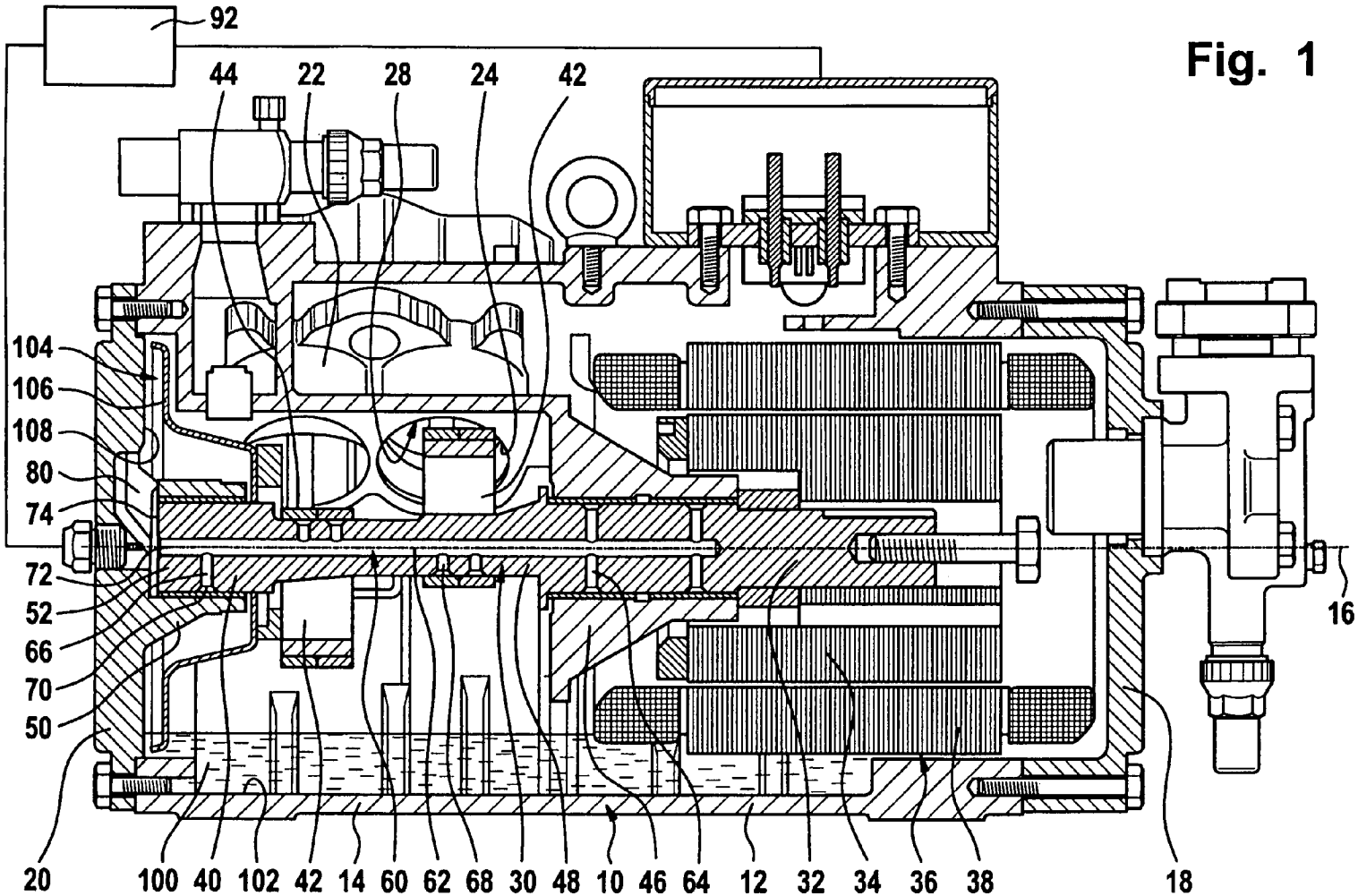
FIG. 1 shows a longitudinal section through a compressor according to the invention.

An embodiment of an inventive compressor for refrigerants, shown in FIG. 1, comprises a housing 10 containing a motor section 12 and a compressor section 14. The housing 10 extends in the direction of a longitudinal axis 16 and in the area of its motor section 12 is closed by a housing cover 18 and in the area of the compressor section 14 by a housing cover 20.

The compressor section 14 contains several compressor units 22, each comprising, for example, a cylinder 24 and a piston 28 movable therein. The compressor units 22 are drivable by a common drive shaft 30 extending through the compressor section 14 and the motor section 12.

A rotor 34 of a motor generally designated 36 is seated on a section 32 of the drive shaft 30 extending in the motor section 12, and a stator 38 of the motor 36 surrounding the rotor is seated in the motor section 12 of the housing 10, so that the rotor 34 directly drives the drive shaft 30.

Furthermore, the drive shaft 30 comprises with its section 40 extending in the compressor section 14 drive elements 42, for example, in the form of eccentrics, on which connecting rods 44 are seated. The drive shaft is mounted in the housing 10, on the one hand, by a bearing body 46 formed on the housing 10 and seated between the motor section 12 and the compressor section 14. The bearing body 46 mounts the drive shaft 30 in the area of a middle section 48 which lies between the section 32 of the drive shaft 30 extending in the motor section 12 and the section 40 of the drive shaft 30 extending in the compressor section 14.

On the other hand, the drive shaft 30 is mounted in a further bearing body 50 arranged at the end of the drive shaft 30. The bearing body 50 is formed on the housing cover 20 closing off the compressor section 14 and receives an end section 52 of the drive shaft facing the housing cover 20.

The drive shaft 30 is provided with a lubricating oil duct system generally designated 60 for lubricating the middle section 48 rotating in the bearing body 46 and the end section 52 of the drive shaft rotating in the bearing body 50 and for lubricating the connecting rods 44 seated on the drive elements 42. The lubricating oil duct system comprises a central lubricating oil duct 62 extending in the axial direction of the drive shaft 30, and branch ducts 64 branching off from the central lubricating oil duct 62, for example, branch ducts 64 for lubricating the middle section 48 of the drive shaft 30 rotating in the bearing body 46, a branch duct 66 for lubricating the end section 52 of the drive shaft 30 rotating in the bearing body 50, and branch ducts 68 for lubricating the connecting rods 44 seated on the drive elements 42.

All these branch ducts 64 to 68 have orifices 70 lying radially outwardly in relation to the central lubricating oil duct 62, so that upon rotation of the drive shaft 30 lubricating oil present in the lubricating oil duct system 60 flows in the direction of the orifices 70.

Figure 2:
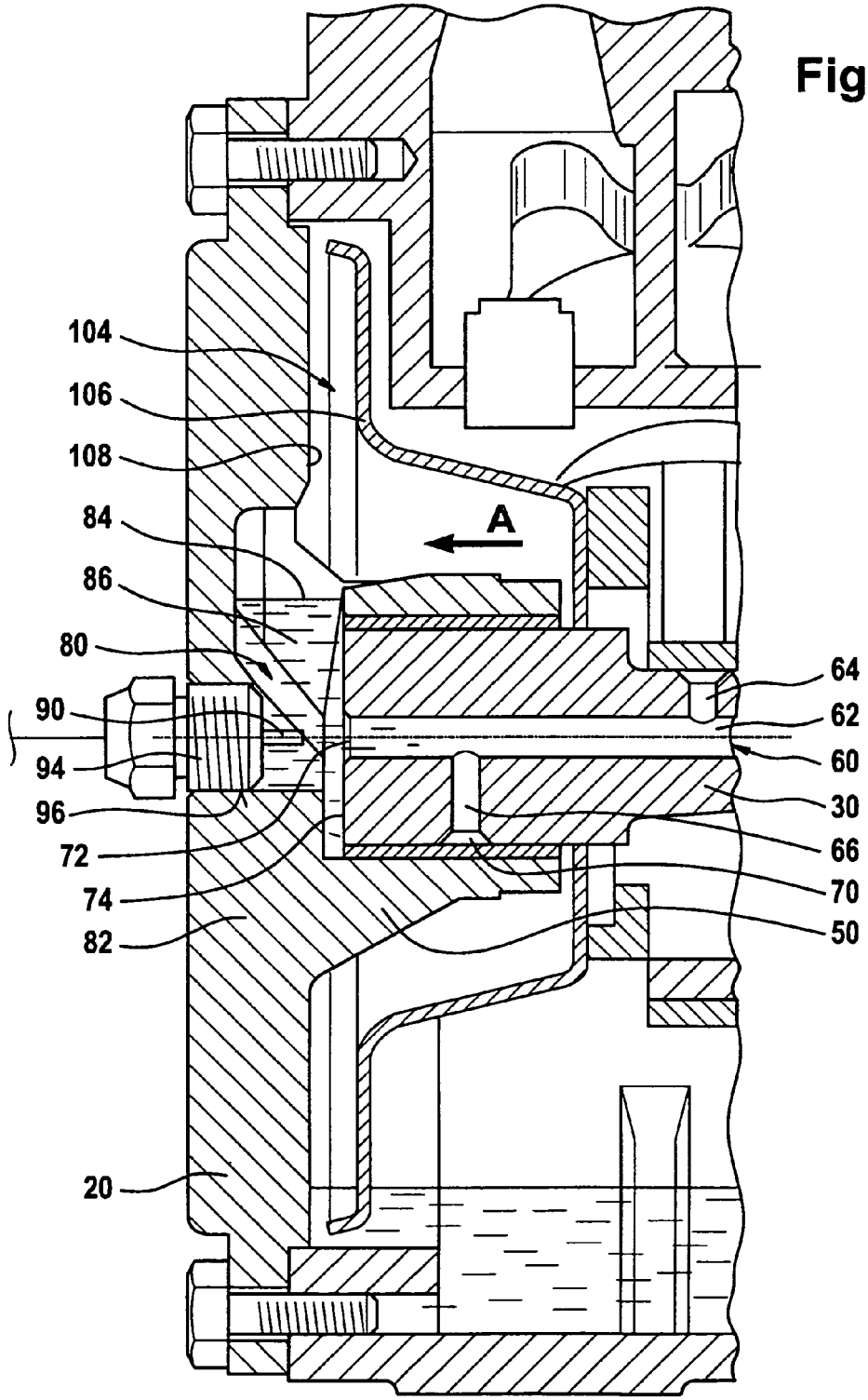
FIG. 2 shows an enlarged illustration of an area of the housing of the compressor with the lubricating oil reservoir.
Figure 3:
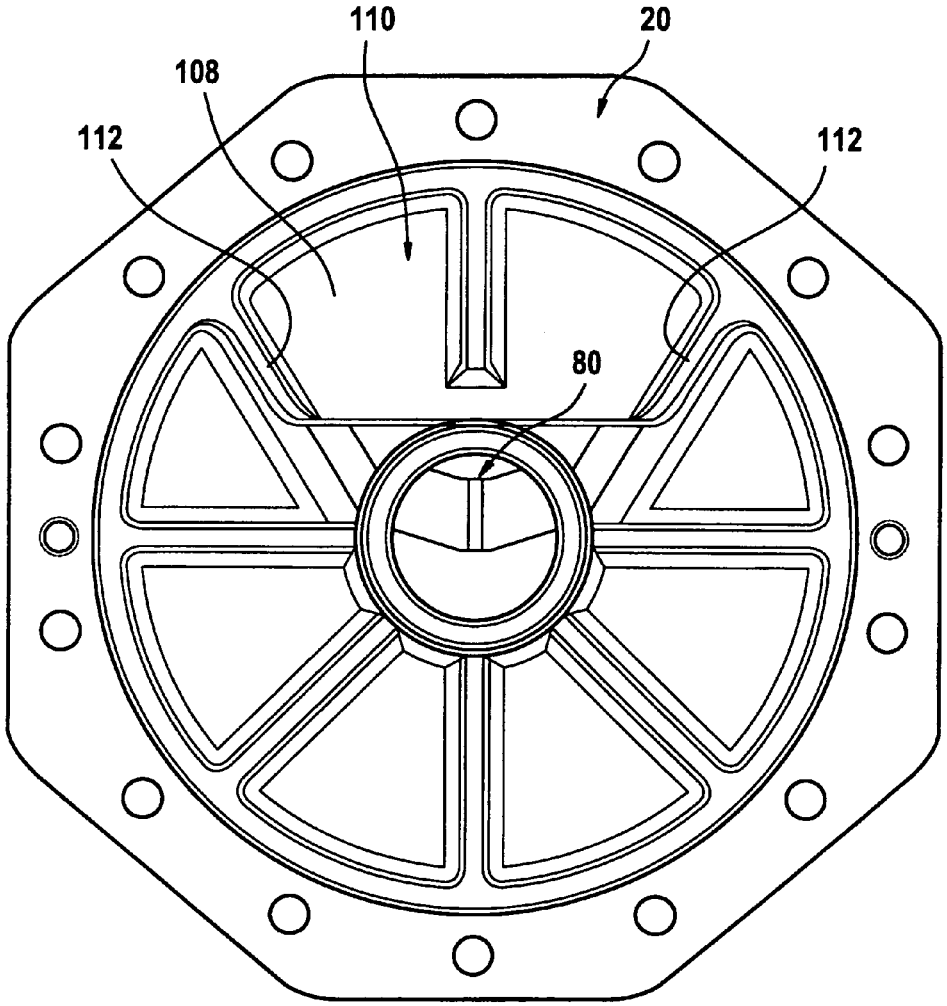
FIG. 3 shows a view in the direction of arrow A in FIG. 2.

The lubricating oil duct system 60 is supplied via an inlet 72 arranged at an end face 74 of the end section 52 of the drive shaft 30 facing the housing cover 20, preferably coaxially with the drive shaft 30. The end face 74 of the drive shaft 30 preferably lies on a side, facing the housing cover 20, of the end section 52 of the drive shaft 30 mounted in the bearing body 50 and adjoins a lubricating oil reservoir 80. As shown on an enlarged scale in FIGS. 2 and 3, the lubricating oil reservoir 80 is formed as a recess in the housing cover 20 on a side facing the bearing body 50 and lies between a cover wall 82 of the housing cover 20 and the bearing body 50 formed on the housing cover 20. The lubricating oil reservoir 80 extends as far as an open side of the bearing body facing the housing cover 20 and in this area is closed substantially by the end face 74.

If the lubricating oil reservoir 80 is filled to such an extent that an oil surface 84 of an oil bath 86 is above the inlet 72, then there is always sufficient lubricating oil available at the inlet 72 to be taken up by the lubricating oil duct system 60 via the inlet 72 while the drive shaft 30 is rotating and to be conducted to the orifices 70 owing to the radial acceleration in the drive shaft 30.

A sensor 90 is associated with the lubricating oil reservoir 80 for monitoring the lubricating oil bath 86 present in the lubricating oil reservoir 80. The sensor 90 cooperates with a lubricating oil monitoring device 92 which switches off the motor 36 when there is insufficient lubricating oil.

For recognizing a shortage of lubricating oil, the sensor 90 could, for example, be designed so as to monitor the level of the oil surface 84 in a non-contacting manner.

The sensor 90 is preferably designed as a sensor which can recognize whether it is in contact with lubricating oil or not.

Such contact with lubricating oil can, for example, be detected via optical characteristics, so that the sensor 90 could be an optical sensor.

A particularly simple embodiment which operates reliably provides for the sensor 90 to operate in the form of a heated thermoelement which is constantly cooled by the contact with lubricating oil and hence does not heat up to any substantial degree, but does heat up strongly in the absence of contact with lubricating oil, and this heating up of the sensor is then detected by the oil lubricating oil monitoring device 92.

In the illustrated embodiment, the sensor 90 is arranged immediately in front of the inlet 72 of the central lubricating oil duct 62 and hence would recognize the absence of lubricating oil in the lubricating oil bath 86 at the level of the inlet 72.

The sensor 90 is preferably screwable with a housing 94 from the outside into a threaded bore 96 in the cover wall 82. The threaded bore 96 opens into the lubricating oil reservoir 80 and is preferably arranged coaxially with the drive shaft 30.

In a preferred embodiment the lubricating oil monitoring device 92 operates in such a way that it switches the motor 36 off when the sensor 90 reports to the lubricating oil monitoring device 92 that it has not been in contact with lubricating oil for longer than a predetermined length of time, for example, for a period of between 60 and 120 seconds, preferably 90 seconds. The advantage of this solution is to be seen in the fact that certain states, for example, a starting-up state in which the lubricating oil bath 86 is not present initially, or other short-term unstable states due to operating conditions, can be bridged without switching off the motor 36.

As the lubricating oil bath 86 in the lubricating oil reservoir 80 lies above a lubricating oil sump 100 forming in the housing 10 near a housing bottom 102, it is necessary to constantly convey lubricating oil from the oil sump 100 into the lubricating oil reservoir 80 by means of a lubricating oil conveying device 104.

Such a lubricating oil conveying device 104 is designed, for example, as an impeller 106 seated on the drive shaft 30 and co-rotating therewith. The impeller 106 dips into the oil sump 100, carries oil therein along with it and whirls the oil against an inner side 108 of the housing cover 20 facing, the impeller 106. In an upper area 110 lying above the lubricating oil reservoir 80 the inner side 108 of the housing cover 20 has ribs 112 which conduct the lubricating oil running off from the area 110 in the direction of the oil sump 100 into the lubricating oil reservoir 80. The impeller 106 is designed such that with co-rotating drive shaft 30 the impeller 106 always conveys sufficient amounts of oil into the lubricating oil reservoir 80 from which this lubricating oil can then be distributed over the lubricating oil duct system 60.

The invention claimed is:

1. Compressor for gaseous media, in particular, refrigerants, comprising a housing, a drive shaft mounted in the housing, at least one compressor unit arranged in the housing and driven by the drive shaft, an oil lubricating device for supplying bearing areas of the drive shaft with lubricating oil, the oil lubricating device comprising a lubricating oil reservoir lying above an oil sump in the housing and fillable from the oil sump by a lubricating oil conveying device, and the oil lubricating device further comprising a lubricating oil duct system extending through the drive shaft for taking up lubricating oil from the lubricating oil reservoir via an inlet disposed on the drive shaft and conducting it to the bearing areas, and a lubricating oil monitoring device for detecting by means of a sensor associated with the lubricating oil reservoir the presence of lubricating oil in the lubricating oil reservoir and switching off the compressor when there is a shortage of lubricating oil.

2. Compressor in accordance with claim 1, wherein the sensor is designed as a sensor which reacts upon contact with lubricating oil.

3. Compressor in accordance with claim 1, wherein the lubricating oil monitoring device recognizes a shortage of lubricating oil when the sensor associated with the lubricating oil reservoir detects no lubricating oil beyond a certain period of time.

4. Compressor in accordance with claim 1, wherein the sensor is associated in such a way with the lubricating oil reservoir that it detects a specified filling level of a lubricating oil bath in the lubricating oil reservoir.

5. Compressor in accordance with claim 4, wherein the filling level of the lubricating oil bath in the lubricating oil reservoir, which is to be detected by the sensor, is specified by it being above the inlet for lubricating oil disposed on the drive shaft.

6. Compressor in accordance with claim 1, wherein the lubricating oil in the lubricating oil reservoir enters the inlet substantially free from being acted upon by pressure.

7. Compressor in accordance with claim 1, wherein the lubricating oil duct system is designed such that with the drive shaft rotating, the lubricating oil duct system conveys lubricating oil as a result of the centrifugal forces from the inlet to the bearing areas to be supplied.

8. Compressor in accordance with claim 1, wherein the lubricating oil reservoir is arranged in the area of a housing wall on which the drive shaft abuts.

9. Compressor in accordance with claim 1, wherein the inlet of the lubricating oil duct system is arranged on an end face of the drive shaft, with which the drive shaft abuts on the lubricating oil reservoir.

10. Compressor in accordance with claim 1, wherein the lubricating oil conveying device comprises an impeller.

* * * * *